US007571888B2

(12) United States Patent
Arozena Bergaretxe

(10) Patent No.: US 7,571,888 B2
(45) Date of Patent: Aug. 11, 2009

(54) FLOOR AND ROOF FORMWORK SYSTEM

(75) Inventor: Alberto Arozena Bergaretxe, Guipuzcoa (ES)

(73) Assignee: Ulma Cye., S. Coop., Guipuzcoa (ES)

( * ) Notice: Subject to any disclaimer, the term of this patent is extended or adjusted under 35 U.S.C. 154(b) by 1010 days.

(21) Appl. No.: 10/677,864

(22) Filed: Oct. 2, 2003

(65) Prior Publication Data

US 2004/0075042 A1 Apr. 22, 2004

Related U.S. Application Data

(63) Continuation of application No. PCT/ES01/00134, filed on Apr. 3, 2001.

(51) Int. Cl.
*E04G 11/38* (2006.01)
*E04G 11/48* (2006.01)

(52) U.S. Cl. ..... 249/18; 108/56.3; 108/156; 108/157.15

(58) Field of Classification Search ..... 249/18, 249/28; 52/126.6; 108/56.3, 150, 155, 156, 108/158.12, 157.15, 157.16, 157.17
See application file for complete search history.

(56) References Cited

U.S. PATENT DOCUMENTS 5,614,122 A 3/1997 Schworer

FOREIGN PATENT DOCUMENTS

| | | |
|---|---|---|
| DE | 3024580 | 1/1982 |
| DE | 19616876 | 11/1997 |
| EP | 0297357 | 1/1989 |
| ES | 1 043 112 | 11/1999 |
| GB | 905410 | 9/1962 |
| GB | 1457136 | 12/1976 |
| WO | 9419562 | 9/1994 |

*Primary Examiner*—Michael Safavi
(74) *Attorney, Agent, or Firm*—Katten Muchin Rosenman LLP

(57) ABSTRACT

A slab formwork comprising vertical props, fixed bolsters mounted on the upper end of the props and shuttering panels supported on the bolsters. In correspondence with the four corners of a planar, horizontal and upper surface of the bolsters, some diagonal protuberances project outward with their upper surface inclined downward toward the interior and with two slopes defining individual inclined planes convergent in a common and longitudinal edge, the upper surface defining the support for the corresponding shuttering panels, the latter having on their corners some reinforcements. There are also defined complementary inclined surfaces to the two slopes of the upper surfaces of the protuberances, those reinforcements being supplemented with lateral flanges by means of which it is possible to hang the shuttering panels, both for carrying out their erection and for their dismantling.

8 Claims, 9 Drawing Sheets

FLOOR AND ROOF FORMWORK SYSTEM

CROSS-REFERENCE TO RELATED APPLICATIONS

This is a continuation of pending PCT Application PCT/ES01/00134 filed Apr. 3, 2001.

FIELD OF THE INVENTION

The present invention relates to a floor and roof form work system, specifically of the type termed slab formwork, although foreseen for forming spaces not excessively wide and especially when the perimeter walls have already been built up. Many elements intervene in a system of this type, such as vertical props, fixed support bolsters, shuttering panels which are mounted directly on the bolsters, extendible panels, main and secondary parapet beams, tripods and hooks, but our invention is centered mainly on a series of novel features of the main components, namely, of the fixed bolsters and formwork panels.

OBJECTS OF THE INVENTION

The object of the invention is to provide the construction sector with a fixed support bolster, as well as a formwork panel, with characteristics such that the use thereof is allowed not only in the formwork of reduced spaces or when the perimeter walls have already been built up, but which can also be used in large-scale formwork to finish off corners or special situations in which it is not possible to use the conventional drop bolsters.

It is likewise an object of the invention to achieve speed and simplicity in the erection of the formwork panels and in the stripping thereof based on said panels, both in their erection and in their stripping, being hung vertically from the bolsters permitting very easy handling.

BACKGROUND OF THE INVENTION

Within the systems of slab formwork, those intended for formwork of large surfaces use fundamentally a series of vertical props, drop bolsters, longitudinal beams which are mounted on said drop bolsters and formwork panels which are mounted on the foresaid beams. The drop bolsters allow the stripping of such panels and beams before final setting of the concrete.

However, for shuttering more reduced spaces, especially when the perimeter walls have already been built up, or in those constructions in which the surface finish is not too demanding, simpler formwork systems are used constituted basically by vertical props, fixed support bolsters and the shuttering panels which are mounted directly on those bolsters, the difference being that when stripping with the fixed bolsters, all the elements are removed at the same time, namely, the panels, the bolsters and the props, for which reason it is necessary to wait for final setting of the concrete before stripping.

Nevertheless, the fixed support bolsters can be used likewise in large-scale formwork to finish off corners or special situations of the formwork in which it is not possible to use drop bolsters, using in these cases and in a combined manner said drop bolsters and fixed bolsters.

Specifically, in the European Patents No 0685022 of Peri and 0297357 of Hünnebeck-RöRo GmbH, as well as in the German Patent No 324580 of Josef Maier, formwork systems are disclosed in which different types of fixed bolster are used upon each of which rest four adjacent formwork panels, that is concurrent in a corner, each company using its own bolsters which adapt to the geometry, also special, of its formwork panels.

SUMMARY OF THE INVENTION

The floor and roof formwork system (slabs) disclosed herein, is based on the use, as is conventional, of a series of vertical props, fixed support bolsters and shuttering panels resting directly on the foresaid bolsters, but with a series of innovations and improvements which affect both the bolsters and the shuttering panels themselves, to achieve a system of simpler implementation than those conventionally available and referred to in the previous section.

More specifically, one of the improvements of the invention consists in that the fixed support bolster which forms part of the formwork system, has at each of the four corners corresponding to the quadrangular shape of its upper and horizontal base, on which precisely the shuttering panels rest, individual diagonal projections which define protuberances both outward and with a slight inclination upward with respect to the horizontal plane of the upper part of the bolster, in such a manner that the support of the panels on the bolsters occurs on these inclined surfaces, resulting in the panels having a tendency to come together or to wedge toward the props, avoiding thereby the joints that could arise in the concurrence of four panels on a single bolster and as a consequence a better surface finish is obtained of the form.

Also, the aforesaid diagonal projections have the particularity that their upper and inclined surface is provided with two longitudinal slopes defining individual inclined surfaces, hipped, and convergent in an intermediate and upper edge which allows a better support of the formwork panels.

Finally, it is mentioned that the diagonal projections are each finished off at the end in a vertical nipple or protuberance, projecting upward, through which the corresponding formwork panels can be suspended vertically.

Another innovation which the system of formwork object of the invention incorporates, affects specifically the shuttering panels themselves, so that since these are of the type of those constituted from a frame with a series of internal reinforcing partitions which support a shuttering skin or surface, has the particularity that in correspondence with its corners a like number of interior reinforcements have been foreseen which, besides stiffening the panel itself, constitute the support surface on the props, specifically on the external diagonal projections of the upper part of the bolsters mounted on the corresponding vertical props, although on certain occasions and in circumstances mandated by the construction the panels can rest directly on the upper horizontal surface of the bolster. Those internal reinforcements foreseen in the corners of the panels, have a lower part with two slopes, complementary to the slopes defined above in the diagonal projections of the bolster, including also some peripheral lugs, below that part with the two slopes of the reinforcements, which constitute the means of retaining the panel itself with respect to the nipples foreseen in the diagonal projections of the bolster, when suspending the panel with respect to the bolster itself.

Another novel characteristic consists in that the upper part of the diagonal projections of the bolster has a slight downward inclination toward the centre, the object being to achieve a tendency to wedge in the panels which rest on those projections, avoiding thereby the joints that could arise in the concurrence of four panels on a single bolster.

Now, in certain formwork situations, such as erection against a wall, the aforementioned assembly cannot be used, since there would be a gap between the formwork panel and the wall. So, in this case the panel instead of resting on the diagonal and external projection foreseen in the corresponding corner of the upper part of the bolster, rests, through an end section of the panel itself, on the planar and horizontal surface corresponding to the upper part of the bolster. In this situation, one panel will rest on each bolster instead of four as was stated previously, although two formwork panels can also be supported, adjacent to each other, in which case the external end sections of the panels will rest on the inclined planes of the diagonal projections foreseen in the corners of the bolster, those end sections of the panels having in this case a complementary inclination to the inclined surfaces of the foresaid diagonal projections of the bolsters.

Finally, it is mentioned that the bolsters include, in their planar and upper part, four central ribs or protuberances, angularly equidistant from each other, which serve as butts in the erection of the formwork panels and also allow the support of the partitions or reinforcement ribs of the shuttering panels in special situations of formwork.

Also, on occasions the bolster object of the invention can be used to support beams on which in turn the panels are mounted, in which case the beams have protuberances underneath, by way of heels, which define a central recess, the heels having an inclined lower surface, complementary to the inclination of the diagonal projections of the bolster, the support of the beam on the bolster being implemented through these inclined surfaces. The central recess of the beam serves to house the central ribs or projections of the bolster, these ribs therefore acting as elements to centre and secure the position of the beam on the bolster.

In erection, two vertical props are mounted first with their corresponding bolsters, and on these a shuttering panel is hung, so that by lifting this panel with an appropriate element, it is possible to position it horizontally and locate below it another two vertical props, the panel resting, through the other two corners thereof, on these second two props, specifically on the bolsters of the same, whereby the shuttering panel is thus located or resting on four bolsters corresponding to a like number of vertical props.

In like fashion the erection of the different panels would be carried out until the surface it is intended to shutter is covered.

Clearly to carry out the stripping operation, one would proceed in the reverse order.

BRIEF DESCRIPTION OF THE DRAWINGS

To complete the description that is being made and with the object of assisting in a better understanding of the characteristics of the invention, in accordance with a preferred example of practical embodiment thereof, accompanying as an integral part of said description, is a set of drawings wherein by way of illustration and not restrictively, the following has been represented.

PREFERRED EMBODIMENT OF THE INVENTION

Figure 1:
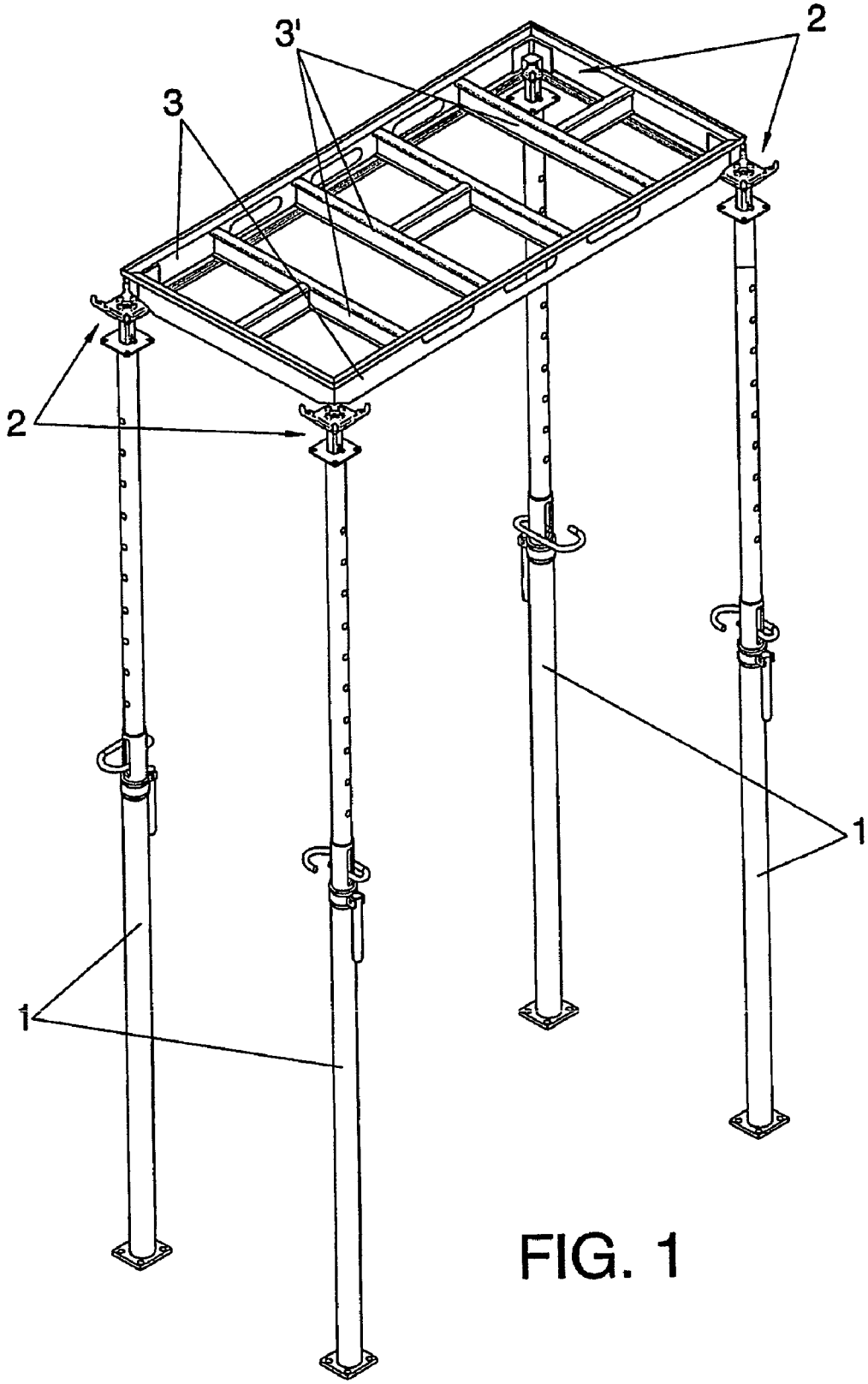
FIG. 1.—It shows a representation according to a general perspective of a shuttering panel resting on the bolsters corresponding to four vertical props.
Figure 2:
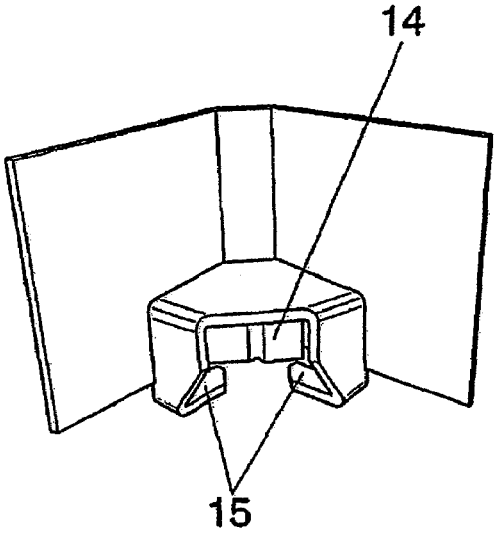
FIG. 2 and 2A—They show two views in perspective, one for the upper part and another for the lower part, of the internal reinforcement included in the shuttering panels in each of their corners.
Figure 2A:
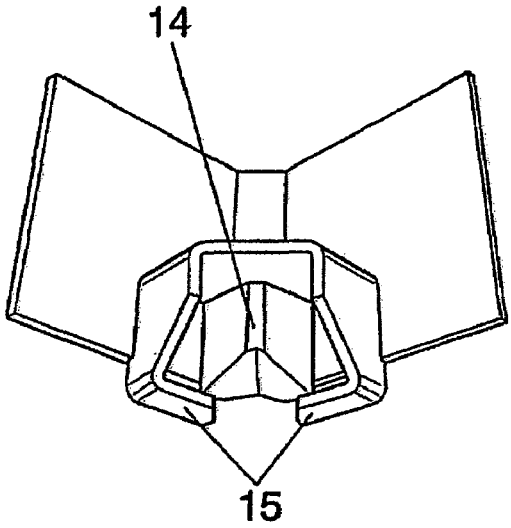
Figure 3:
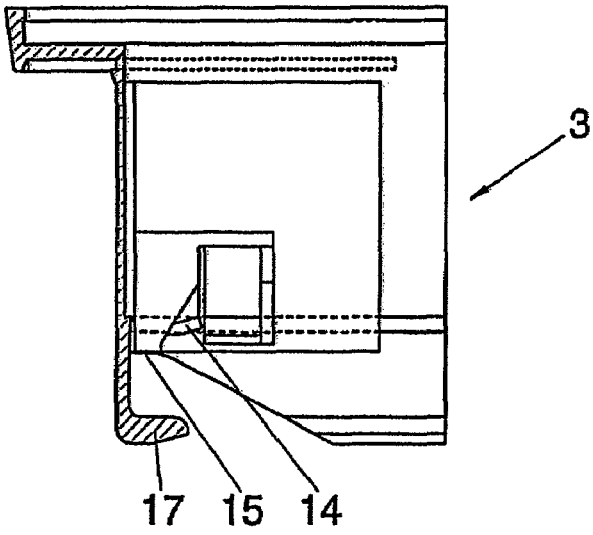
FIG. 3.—It shows a detail in cross section of the corner of a shuttering panel where it is possible to see the interior profile of the latter and the reinforcement of the corner itself.
Figure 4:
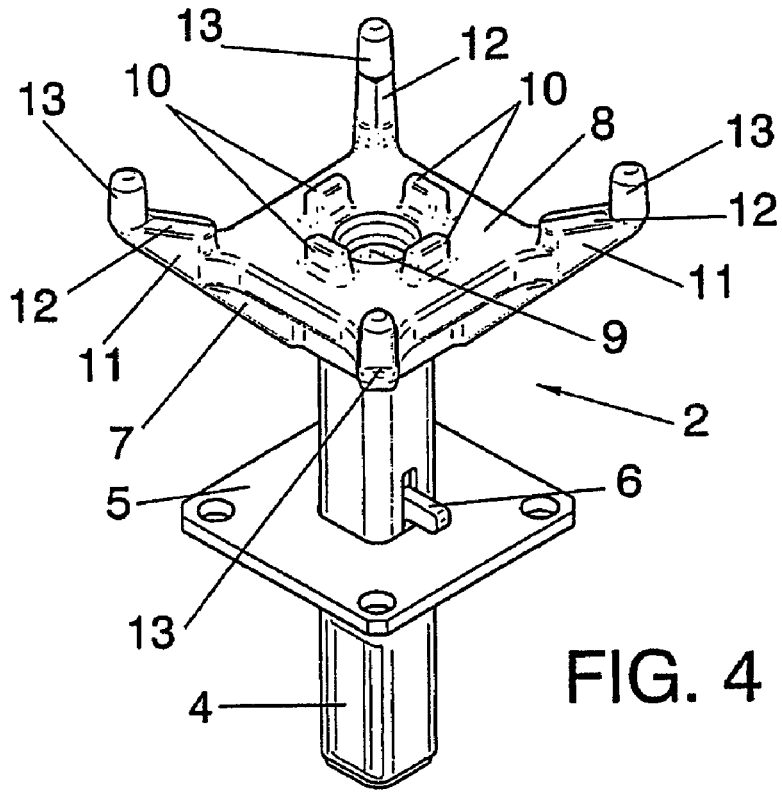
FIG. 4.—It shows a view in perspective of a fixed bolster used in the system of formwork object of the invention.
Figure 5:
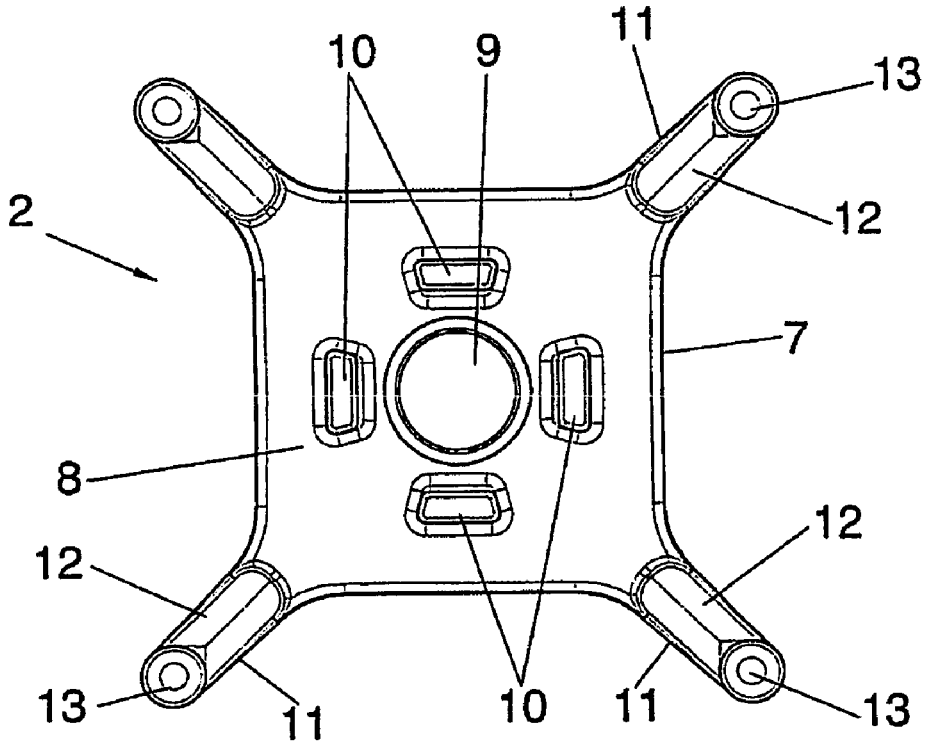
FIG. 5.—It shows a top plan view of the same bolster represented in the previous figure.
Figure 6:
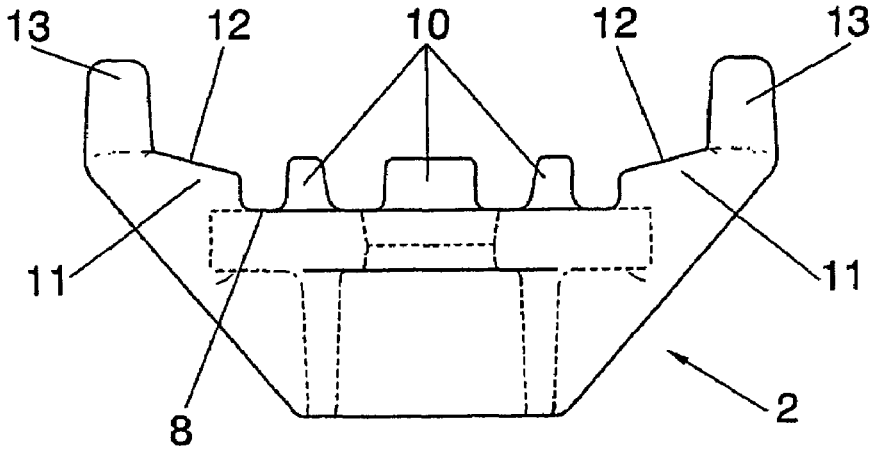
FIG. 6.—It shows a side view in profile of the bolster represented in the two previous figures.
Figure 7:
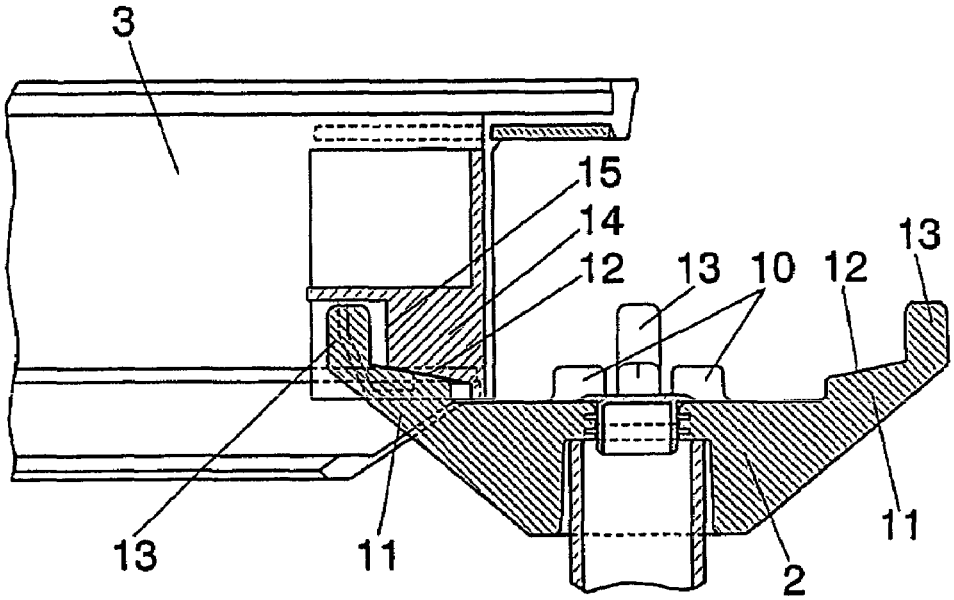
FIG. 7.—It shows a side view in cross section of the end part corresponding to a shuttering panel resting on the respective bolster.
Figure 8:
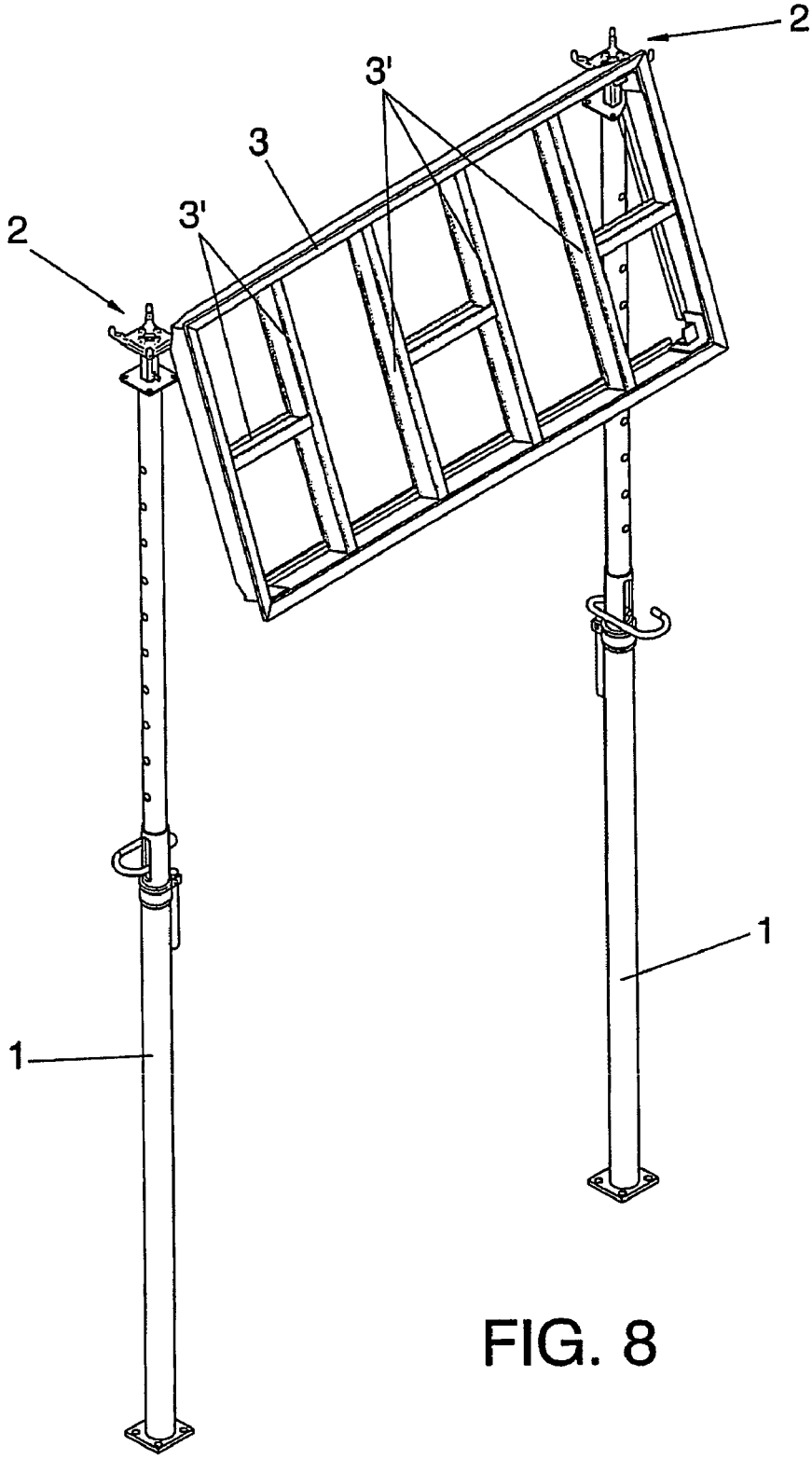
FIG. 8.—It shows a view in perspective of the way in which a shuttering panel hangs with respect to two bolsters foreseen in the upper part of the respective vertical props, it being observed how that shuttering panel is in a position close to vertical.

In the light of the aforesaid figures, the system of formwork of the invention, employable basically for shuttering reduced spaces in which the perimeter walls of the construction have been built before implementing the corresponding slabs, comprises: a series of vertical props (1); fixed bolsters (2), mounted on the upper part of the props (1), and shuttering panels (3) which rest on the bolsters (2).

The support of the shuttering panels (3) on the fixed bolsters (2), is implemented in a particular way, whereby both the latter and the panels themselves have some special characteristics which enable erection in a simple manner, as well as effective form striking, without risk of the panels falling to the ground, achieving also a good seal between panels which avoids the formation of joints between the panels.

Specifically, the bolsters (2) are constituted starting from a main tube (4), which is coupled to the corresponding prop (1) by insertion of said main tube (4) in the hollow upper end of the foresaid prop, until abutting against the plate (5) which the main tube (4) itself has for this purpose at an approximately intermediate height, the latter having a retractable latch defining a coupling (6) makes the bolster (2) non-detachable with respect to the prop (1).

The most fundamental characteristics of the foresaid bolster (2), correspond to its upper part, formed by a quadrangular body (7) of planar and horizontal upper surface (8), with a central orifice (9) which can be open or filled with an appropriate plug, around which four symmetrical protuberances (10) have been foreseen; whilst the corners of the body (7) are prolonged in a like number of external and diagonal protuberances or projections (11) with their upper surface (12) inclined lengthwise downward toward to the centre, that upper surface (12) being determined by two inclined and concurrent planes in an intermediate and longitudinal edge which is established in said upper surface (12). The diagonal protuberances or projections (11) are finished off at their end in a nipple (13) projecting upward, the function of which will be explained later.

For their part, the shuttering panels (3) used in the system, are of the type of those constituted by a metallic frame with internal partitions (3') for stiffening and the corresponding surface defining the shuttering skin. Said panels (3) have on their corners respective internal reinforcements (14), constituted by some boxes which have a supporting surface formed by a pair of planes inclined toward the interior, complementary to those foreseen on the upper surface (12) of the protuberances (11) of the body (7) of the bolster (2), to achieve a correct support of those internal reinforcements (14) of the panels (3) in the protuberances (11) of the bolsters (2), this support being implemented through the aforementioned inclined surfaces, which make the panels wedge into the prop avoiding the formation of joints between two panels.

Also, the aforesaid internal reinforcements (14) of the panels (3) are supplemented with some flanges (15) which permit the panels (3) themselves to be hung vertically, through coupling on such flanges (15) of the nipples (13) of the bolster (2) itself, resulting useful both in the erection and in the striking of the formwork.

Figure 10:
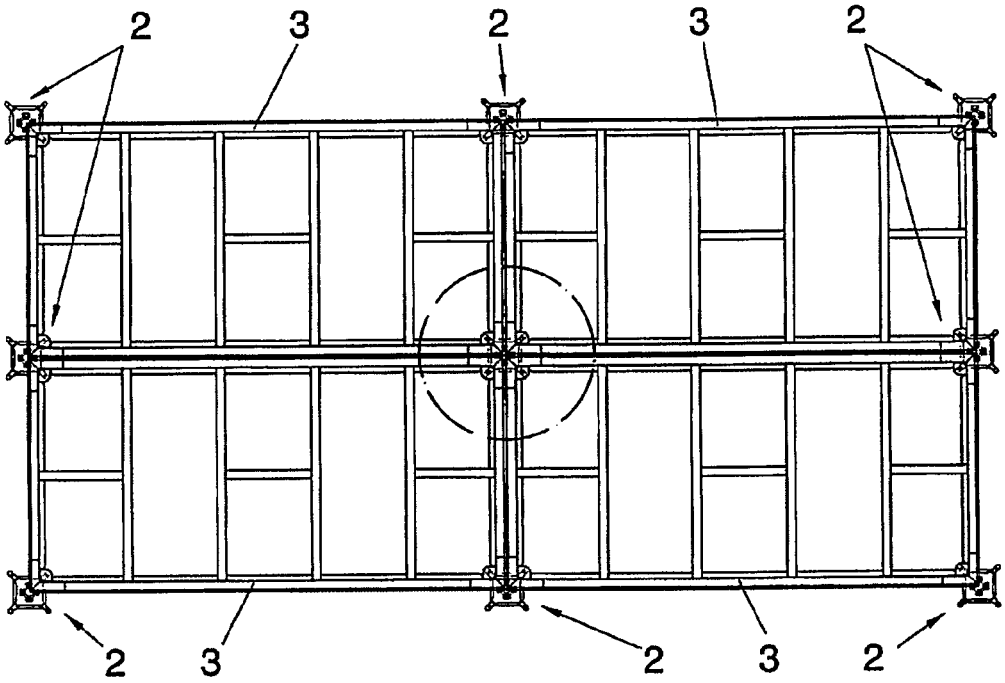
FIG. 10.—It shows a plan view of the erection of four shuttering panels arranged at right angles to each other and concurrent in a central and common point.
Figure 11:
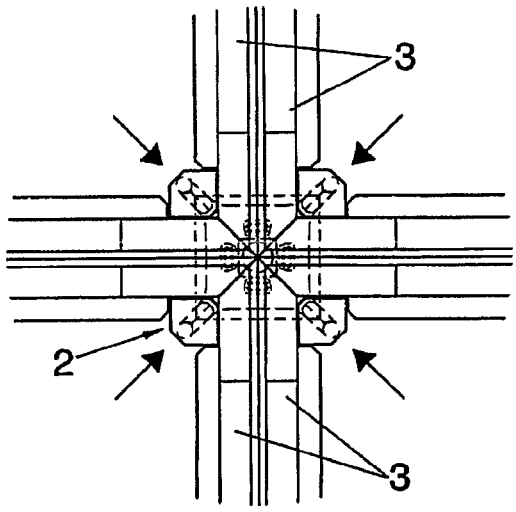
FIG. 11.—It shows a detail of the junction of the four panels represented in the previous figure, wherein the arrows indicated represent the tendency of such panels to come together, avoiding thereby joints which could leave a poor finish.

The bolsters (2) are structured in the foresaid way to allow the support on each of them of four shuttering panels (3), as seen in FIGS. 10 and 11, the inclined planes of the reinforcements (14), corresponding to the corners of the panels (3), resting on the complementary and upper surface (12) corresponding to the diagonal protuberances or projections (11) of the bolsters (2), so that erection will begin by emplacing two props (1) with their corresponding bolsters (2), stabilized with the use of corresponding tripods, and subsequently hanging a panel (3) from the bolsters (2) corresponding to those two props (1). The hanging, as has already been said, is achieved by a coupling between the nipples (13) of the bolsters (2) and the flanges (15) of the panels (3). Next, by means of a hook or appropriate element, the panel (3) is rotated from its hanging vertical position until it is positioned horizontally, arranging other two props (1), under said panel (3), so that the latter rests on the bolsters (2) of this second pair of props, a structure being formed thereby of four props with their bolsters and a shuttering panel, as is represented in FIG. 1, starting from which it will be possible to build a grid of panels (3) growing in both directions at right angles until the entire slab to be concreted is complete.

Figure 9:
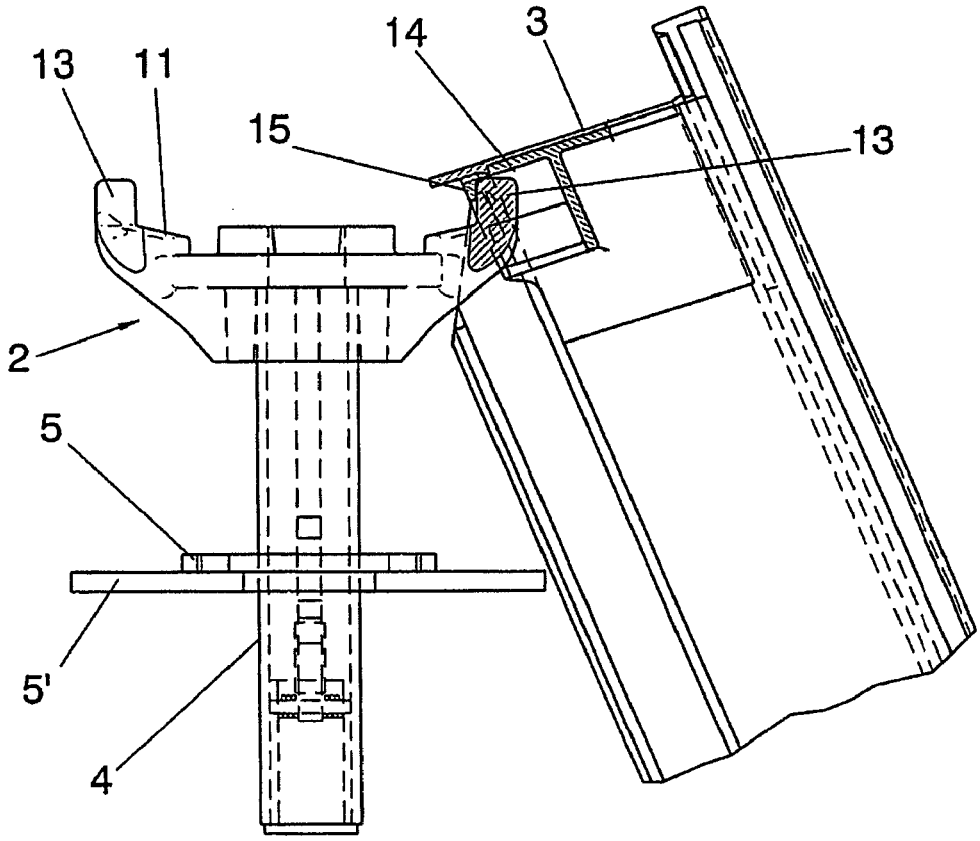
FIG. 9.—It shows a detail in cross section of the way in which the shuttering panel is coupled to the bolster.

The configuration, arrangement and orientation of the protuberances (11) of the bolsters (2) allow the free and sufficient rotation of the shuttering panel (3) during erection, whilst the space between the end plate (5) and the lower part of the body (7) of the bolster (2), is sufficient for the rotation of the panel (3) with respect to the bolster (2) itself not to be impeded by the upper plate (5') of the prop (1), against which the plate (5) of the bolster (2) abuts precisely, as is represented in FIG. 9.

Figure 12:
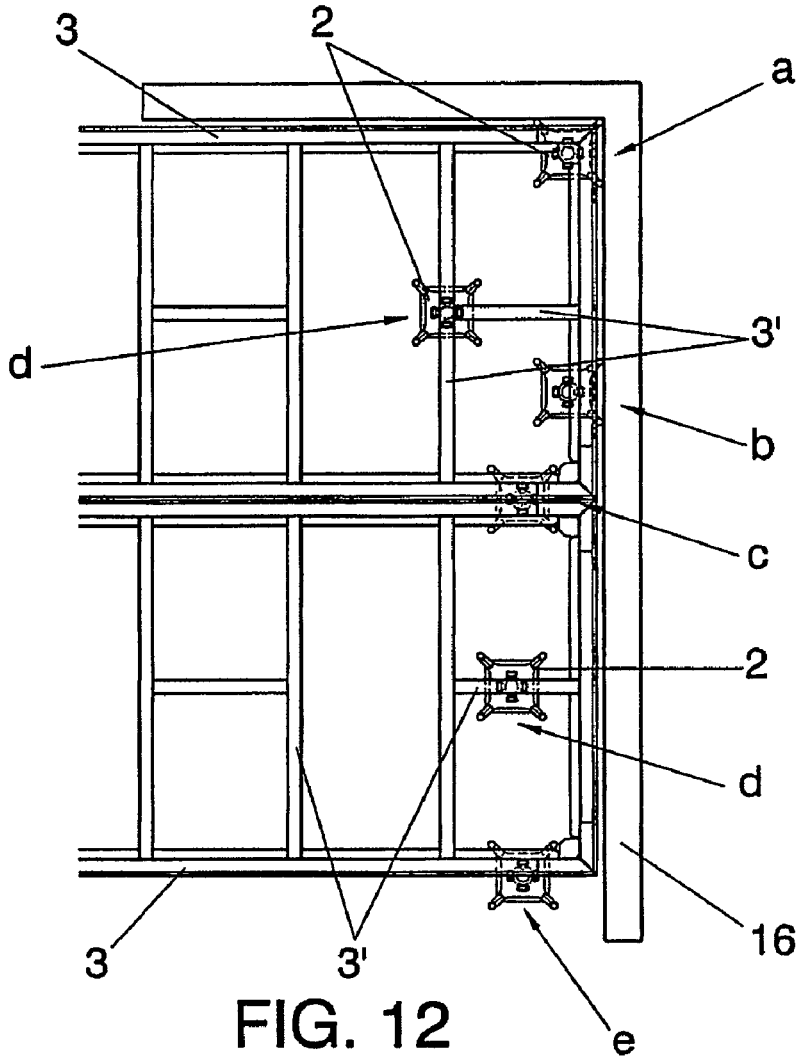
FIG. 12.—It shows a plan view of several forms of supporting the shuttering panels on respective bolsters, it being possible to see the arrangement which the props can adopt under the panels themselves, in erections against a wall.

When a formwork erection has to be made against a wall (16), as is represented in FIG. 12, the arrangement of the bolsters must be such that they do not make contact with the face or wall (16) in question, it being possible for the cases represented in the foresaid FIG. 12 to arise, and which are:

a. The bolster (2) can be located in the corner of a panel (3). In this case the planar surface corresponding to the lower profile (17) of the panel (3) rests on the planar surface (8) of the body (7) corresponding to the bolster (2). This type of support is useful if the dimensions of the plate (5') of the prop (1) are less than the dimensions of the bolster (2).

b. In the event that the plate (5') of the prop (1) is greater than the dimensions of the bolster (2), then a special bolster will be used with which it will be possible to avoid gaps being left between panels and the wall (16).

c. Supporting two panels (3) on the bolster (2) of one prop (1).

d. Supporting the panels (3), through their partitions (3'), on the bolsters (2) of respective props (1).

e. Supporting the peripheral profile of the panels (3) on a special bolster.

As has already been stated above, the bolsters (2) are foreseen so that each of them can habitually support four shuttering panels, as is represented clearly in FIG. 10, it being possible to see in detail in FIG. 11 the tendency, indicated by the arrows, of the four panels (3) to come together in the centre, due to the inclination of the upper surface (12) corresponding to the protuberances (11) on which precisely rest the panels (3) through their reinforcement (14). Thus, in the erection of the formwork against the wall, as has been said previously and as is represented in FIG. 12, the panel (3) does not rest on the inclined surface (12) of the protuberance (11) corresponding to the bolster (2), but rather the end profile (17) of the panel (3) will rest on the planar surface (8) of the body (7) of the bolster (2). In this situation, each bolster (2) supports one panel (3) instead of four as in the previous case.

Figure 13:
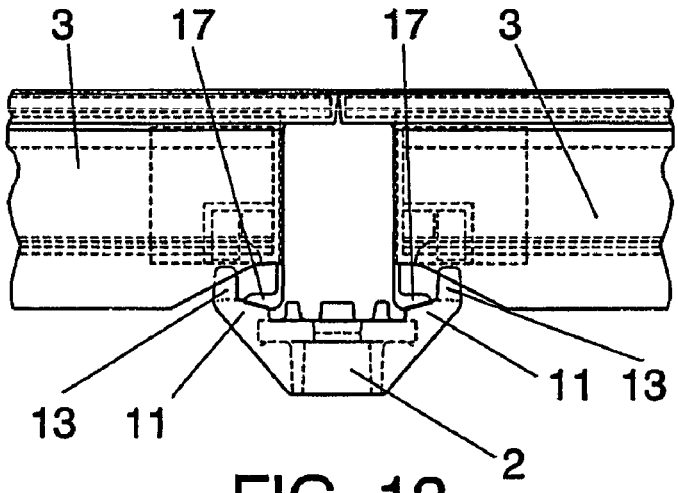
FIG. 13.—It shows, finally, a detail in side elevation of the arrangement of two panels resting on a bolster.
Figure 14:
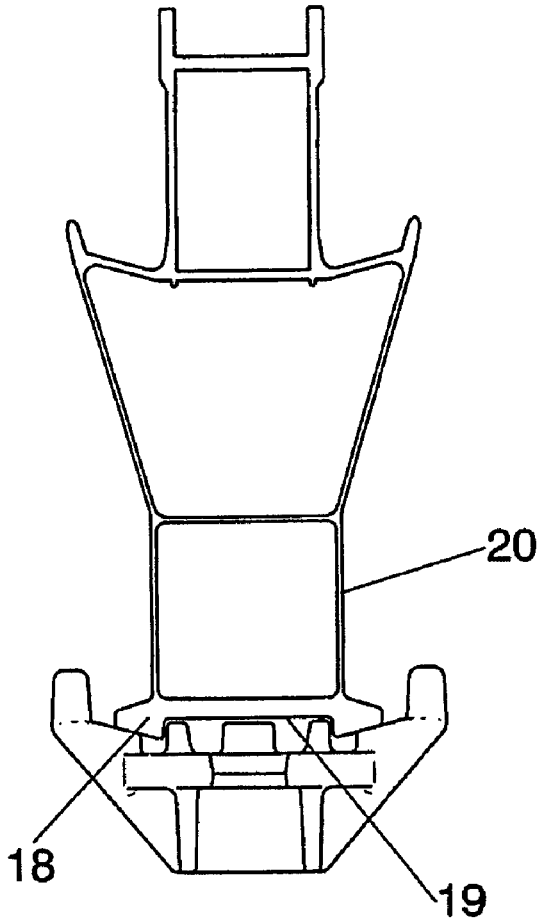
FIG. 14.—It shows a view in profile of an application in which the bolster of the invention is used with a system of formwork of beams and panels, highlighting mainly the supporting elements between bolster and beam.

However, the bolster (2) can also serve to support two shuttering panels, as is represented in FIG. 13, in which case the lower profiles (17) of such shuttering panels (3) rest on the inclined planes corresponding to the upper surface (12) of the protuberances (11) of the bolster (2), so that the ends of those profiles (17) therefore have a slight inclination complementary to that established in the upper and inclined surface (12) of the protuberances or projections (11) of the bolster.

Clearly, on the inclined surface of those protuberances (11) of the bolsters (2), support beams can rest used to hold up the shuttering panels (3), to which end the beams have a complementary support base to establish a correct abuttal between parts.

It is also necessary to highlight the fact that the symmetrical and intermediate protuberances (10) established on the upper surface (8) of the bolsters (2), serve as a butt in the erection of the panels on the bolster and they also allow the direct support of the stiffening or reinforcing partitions (3') corresponding to the shuttering panels (3), when necessary, according to the particularities of the erection in each case.

Also, on occasions the bolster object of the invention can be used to support beams on which in turn the panels are mounted, in which case the beams (20) have some protuberances (18) underneath, by way of heels, which define a central recess (19), the heels (18) having an inclined lower surface, complementary to the inclination of the diagonal projections (11) of the bolster (2), the support of the beam (20) being implemented on the bolster (2), through these inclined surfaces. The central recess (19) of the beam serves to house the central ribs or protuberances (10) of the bolster, these ribs therefore acting as centering and securing elements of the position of the beam on the bolster.

The invention claimed is:

1. A floor and roof formwork system for forming reduced spaces, the system comprising:

a grid structure defined by a series of vertical props, a like number of fixed bolsters mounted on the upper part of the props, and a plurality of formwork panels which rest on the bolsters mounted on the props, wherein the bolsters are disposed on a main tube for coupling by insertion on an upper and hollow end of the respective prop, wherein each of the plurality of formwork panels comprises a metallic rectangular frame with stiffening partitions and a planar panel surface determining a formwork skin, wherein each of the bolsters comprises on top a bolster body having a quadrangular shape and a planar and horizontal upper bolster surface (8), each bolster comprising in the corners of the bolster surface one of a plurality of individual diagonal bolster projections, each bolster projection is inclined downward toward the interior of the bolster surface and comprises a projection edge, each projection edge comprising two slopes disposed centrally and longitudinally along the projection edge, the projection edge for supporting the corresponding formwork panels in a formwork corner, the formwork panels having internal reinforcements, each formwork corner having internally two inwardly convergent inclined formwork corner surfaces which determine a complementary configuration to that of the upper projection surface of the bolster to support the formwork panels on the bolsters resulting in the formwork panels having a tendency to come together preventing formation of joints in a concurrence of the formwork panels when they are mounted on the same bolster.

2. Floor and roof formwork system according to claim 1, wherein an end of the diagonal projections (11) of the bolsters (2) comprises a cylindrical nipple (13) projecting vertically upward which simplifies positioning of the formwork panel on the bolster and also allows the formwork panel to hang, vertically, both when erecting and when dismantling or striking, the formwork panels (3).

3. Floor and roof formwork system according to claim 2, wherein the internal reinforcements (14) of the formwork panels (3) are supplemented with horizontal flanges (15) through which the hanging of the formwork panels (3) is achieved with respect to the nipples (13) of the bolster body (7) of the bolsters (2).

4. Floor and roof formwork system according to claim 1, wherein the bolster body (7) of the bolsters (2) has on the bolster surface (8), a protuberance (10) arranged symmetrically between a center and a perimeter of the bolster surface, which serve as butts during erection of the formwork panels and which also allow support of stiffening partitions (3) of the formwork panels (3), under special conditions of formwork.

5. Floor and roof formwork system according to claim 1, wherein each bolster (2) conjointly supports four formwork panels (3), the formwork panels coming together due to an inclination of projection surface (12) on which the respective reinforcement (14) of the formwork panels (3) rests.

6. Floor and roof formwork system according to claim 1, wherein each bolster (2)supports a pair of formwork panels (3) by supporting a lower and external section (17), the metallic rectangular frame of the panels (3) being supported on the inclined surfaces (12) of the projections (11) of the respective bolster (2).

7. Floor and roof formwork system according to claim 1, further comprising a beam, the beam comprising a plurality of heels defining a central recess (19), each of the heels (18) having an inclined lower heel surface complementary to the inclination of the diagonal projections (11) of the bolster (2) for supporting the beam (20) by the respective bolster (2), the respective bolster comprising a plurality of protuberances and being disposed in the central recess (19) of the beam when the the beam is secured on the bolster.

8. A floor and roof formwork system, the system comprising:

a grid structure comprising a plurality of props and a plurality of support panels;

a bolster provided on each prop, the bolster for supporting at least one support panel, the bolster comprising a bolster surface and a plurality of diagonal bolster projections disposed at each corner of the bolster surface;

each bolster projection being inclined downward toward the interior of the bolster surface and comprising a projection edge for supporting the corresponding support panels in a formwork corner, the projection edge comprising two slopes disposed centrally and longitudinally along the projection edge, wherein each support panel comprises an internal reinforcement, each formwork corner having internally two inwardly convergent inclined formwork corner surfaces which determine a complementary configuration to that of the upper projection surface of the bolster to support the formwork panels on the bolsters resulting in the formwork panels having a tendency to come together preventing formation of joints in a concurrence of support panels that are mounted on the same bolster.

* * * * *